US006963037B1

(12) United States Patent
Bennett et al.

(10) Patent No.: US 6,963,037 B1
(45) Date of Patent: Nov. 8, 2005

(54) LOCKOUT BOX FOR A PENDANT

(76) Inventors: Paul E. Bennett, 1118 Lyric La., Pasadena, TX (US) 77503; Jack S. Taylor, 214 Staitti, Humble, TX (US) 77338

( * ) Notice: Subject to any disclaimer, the term of this patent is extended or adjusted under 35 U.S.C. 154(b) by 67 days.

(21) Appl. No.: 10/855,107

(22) Filed: May 27, 2004

(51) Int. Cl.[7] ..... H01H 9/28
(52) U.S. Cl. ..... 200/43.22; 200/43.16
(58) Field of Search ..... 200/43.16, 298, 200/43.18, 297, 43.19, 333, 43.22, 334, 43.11, 200/50.01, 50.1

(56) References Cited

U.S. PATENT DOCUMENTS 2,579,168 A * 12/1951 Ballou ..... 200/50.36
2,979,581 A * 4/1961 Ballou ..... 200/43.13
3,932,721 A * 1/1976 Crowell et al. ..... 200/302.2
4,520,247 A * 5/1985 Pancook et al. ..... 200/298
4,540,858 A * 9/1985 Knoop ..... 200/5 R
4,789,135 A 12/1988 Watanabe
5,007,543 A * 4/1991 Cooke ..... 212/285
5,095,409 A * 3/1992 Dematteo et al. ..... 362/23
5,488,208 A * 1/1996 Seewald ..... 200/43.22

* cited by examiner

*Primary Examiner*—Elvin G Enad
*Assistant Examiner*—Lisa Klaus
(74) *Attorney, Agent, or Firm*—Bracewell & Giuliani LLP

(57) ABSTRACT

An enclosure restricts access to control buttons of an overhead crane pendant. The enclosure has sidewalls, a top piece, a back piece and a bottom piece. A hinged portion of the enclosure carries a door with an aperture. An appropriate blocking plate is slid into position behind the aperture, thereby blocking the appropriate control buttons, but allowing the other control buttons to remain accessible through the aperture. The lockout box is lockable, and once locked the blocking plates are not movable.

19 Claims, 5 Drawing Sheets

LOCKOUT BOX FOR A PENDANT

BACKGROUND OF THE INVENTION

1. Field of the Invention

The present invention relates to pendant controls, specifically to selectively block access to certain control buttons of an overhead crane pendant while leaving others accessible.

2. Background of the Prior Art

A pendant is a control unit comprised of control buttons that perform different tasks. The pendant is attached to equipment by a cable for controlling the equipment. Pendants are used for controlling a variety of equipment, one example being an overhead crane in a factory setting. The pendant is suspended by the crane in a position for reaching by a user. The controls on the pendant allow movement of the crane hook up and down as well as moving the entire crane in two different directions.

When a break down happens in an overhead crane, the crane may be inoperable until repaired. A repairman may not be available, or it may be necessary to order parts, thus placing the crane out of commission for some time. During this down time the crane typically shouldn't be used, depending on the type of problem. While one can cut off the power to the crane, this normally can be done only at the overhead crane itself, involving a worker climbing up to the overhead rails. It might be necessary while the crane is down to use it to some extent, perhaps just to move it out of the way of other work taking place. If the power is cut off, this requires a worker to climb up to the unit on the overhead rails, thus is time consuming. Consequently, it has been continuously observed when a repairman is not available that control buttons on pendants are wrapped with tape by field personnel not familiar with code rules, regulations or even their own company policies on lock-out/tag-out procedures if the overhead crane is partially inoperable, indicating that those particular control buttons are not to be used. Accidentally, however, an operator could press the wrong control buttons, and damage to the crane or an accident may occur. Also, the tape might be wrongly removed, allowing access to all of the buttons while the crane is still partly inoperable. Therefore, a need to more securely lock out the control buttons of the pendant is needed.

BRIEF SUMMARY OF THE INVENTION

The pendant is placed into a lockout box comprised of an enclosure, a door, an aperture, a blocking plate and a slot for the cable of the pendant to slide into. Once the pendant is placed inside, the blocking plate is slid into place covering the selected control buttons of the operation or function under repair. The door then is shut and the lockout box padlocked to prevent the untimely removal of the blocking plate. The control buttons under the blocking section of the blocking plate are inaccessible, while the control buttons located in the non-blocking section of the blocking plate are accessible through the aperture and the open section of the blocking plate. The accessible control buttons may have various functions.

Once the machinery is repaired, the lockout box is unlocked and the pendant removed from the enclosure. The lockout box lessens the chance for an accidental manipulation of the control buttons of the machinery while under repair.

DETAILED DESCRIPTION OF THE PREFERRED EMBODIMENT

Figure 1:
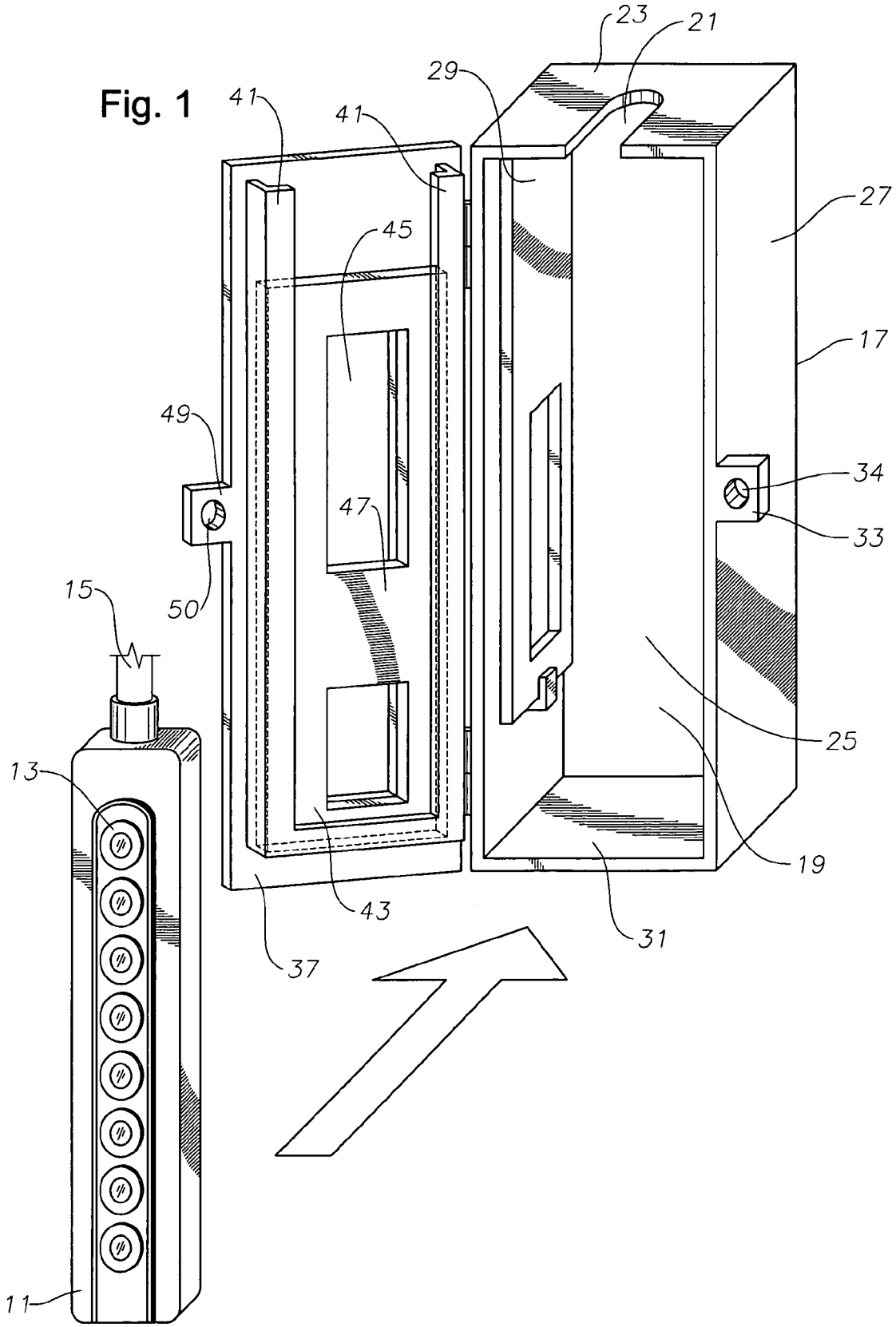
FIG. 1 is a perspective view of a lockout box constructed in accordance with the invention indicating how a pendant will be placed into the enclosure.

Referring to FIG. 1, a pendant 11 having control buttons 13 and a cable 15 fits into a lockout box 17 by placing pendant 11 into an enclosure 19. Cable 15 extends from pendant 11 through a slot 21 cut into a top piece 23 of enclosure 19. Pendant 11 is connected to and controls a piece of equipment, such as an overhead crane.

Figure 2:
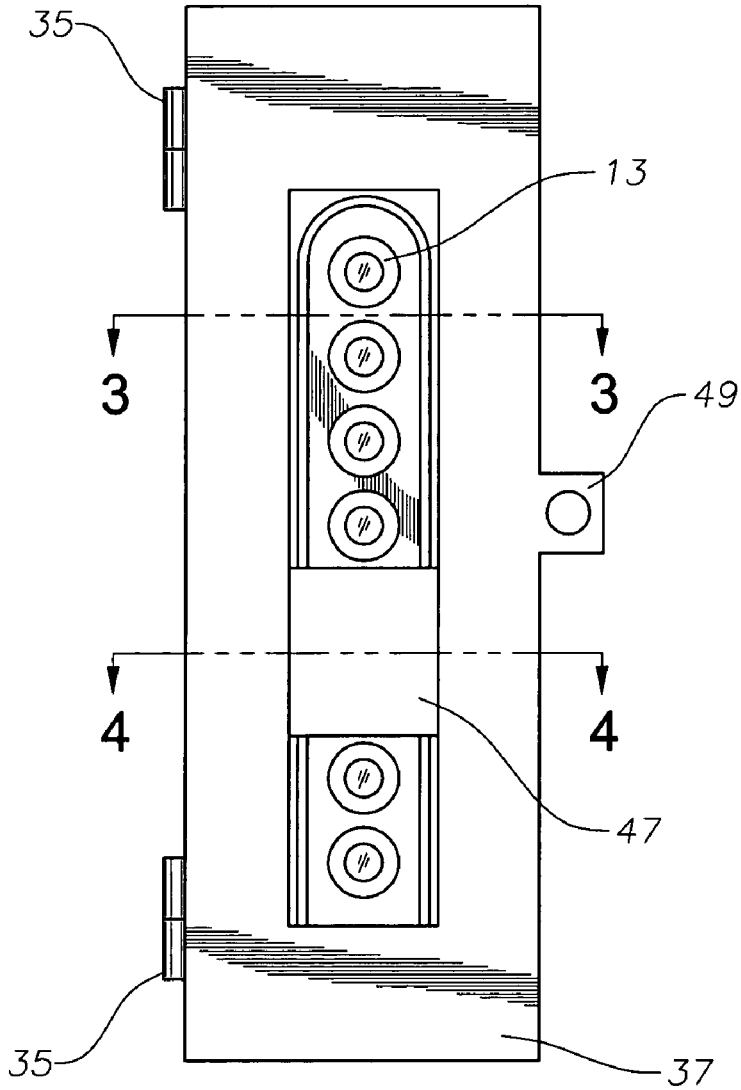
FIG. 2 is an elevational view of the front of the lockout box with the pendant inside, and with a blocking plate in a blocking position thereby covering one or more of the control buttons on the pendant.

Enclosure 19 has of a back piece 25 affixed to two sidewalls 27 and 29. Sidewall 27 had a hasp 33 affixed on its exterior side, while sidewall 29 has hinges 35 (FIG. 2) attached to its exterior side. Top piece 23 and a bottom piece 31 are affixed to sidewalls 27, 29. Bottom piece 31 supports pendant 11 while inside enclosure 19. A door 37 is secured to sidewall 29 by hinges 35 that enable it to swing open and closed.

Figure 3:
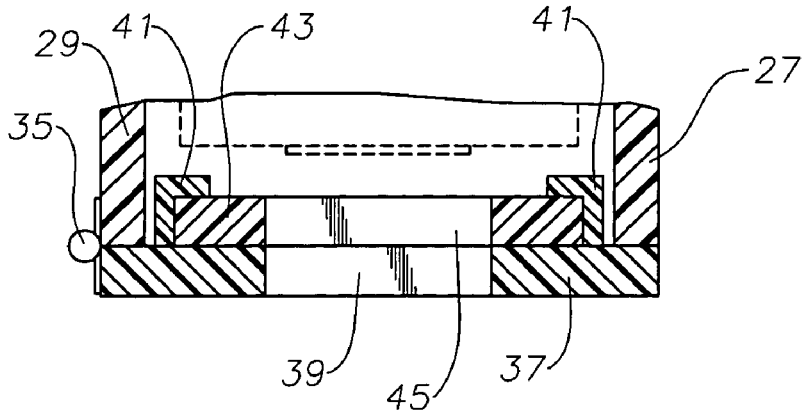
FIG. 3 is a partial sectional view of the door of the lockout box of FIG. 1, taken along the line 3—3 of FIG. 2.
Figure 4:
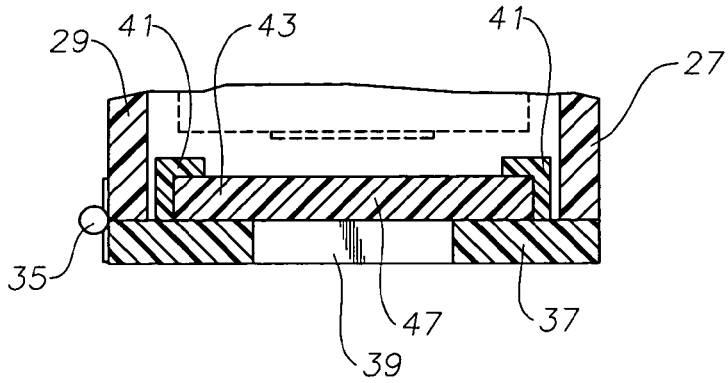
FIG. 4 is a partial sectional view of the door of the lockout box of FIG. 1, taken along the line 4—4 of FIG. 2.

Door 37 has an aperture 39 (FIG. 3) that is preferably rectangular and extends a length greater than a distance between the top and bottom control buttons 13. Aperture 39 is narrower than its length, with a width less than the width of pendant 11 but sufficiently wide to provide access to control buttons 13. Aperture 39 thus provides access to all of the control buttons 13. Door 37 has two longitudinally extending runners 41 on its inner side for a blocking plate 43 to slide on. Runners 41 are L-shaped frame members affixed to the interior portion of door 37, each extending the length of aperture 39. Each runner 41 has a first portion that is perpendicular to the interior portion of door 37 and a second portion that is parallel with door 37. Runners 41 face each other so as to provide a slot for blocking plate 43 to slide along.

Blocking plate 43 has a width equal or greater than the width of aperture 39 and a length equal or greater than the length of aperture 39. In this embodiment, blocking plate 43 has one or more holes 45, with two being shown in FIGS. 1 and 2. Each hole 45 is configured to provide access to one or more control buttons 13. The solid portions 47 of blocking plate 43 between holes 45 that align with door aperture 39 block access to one or more of the other control buttons 13. When blocking plate 43 slides into place parallel with door 37, blocking portion 47 restricts access to certain control buttons 13, and holes 45 allow access to other control buttons 13. The blocking plate 43 shown may be inverted to block access to different control buttons 13, because blocking portion 47 is closer to one end then the other. Various blocking plates 43 may be used, some with only one hole 45 at various positions, and others with two, to block access to different control buttons 13. The holes 45 could be of different sizes. These different blocking plates 43 are interchangeable.

Once the appropriate blocking plate 43 is slid into place in runners 41 and pendant 11 is placed into enclosure 19, door 37 is shut and locked using hasps 33 and 49. Holes 34 and 50 of hasps 33 and 49 line up to allow a padlock to pass through holes 34 and 50 and lock enclosure 19 to door 37. Once locked, blocking plate 43 cannot be removed from the blocking position until the padlock is removed and door 37 opened. The remaining unblocked control buttons 13 remain accessible through aperture 39 and holes 45. The unblocked control buttons 13 allow for the safe and continued operation of the machinery controlled by pendant 11, while the blocked control buttons 13 are inaccessible because of blocking portion 47, thereby lessening the chance for an accidental manipulation of the blocked control buttons 13.

Figure 5:
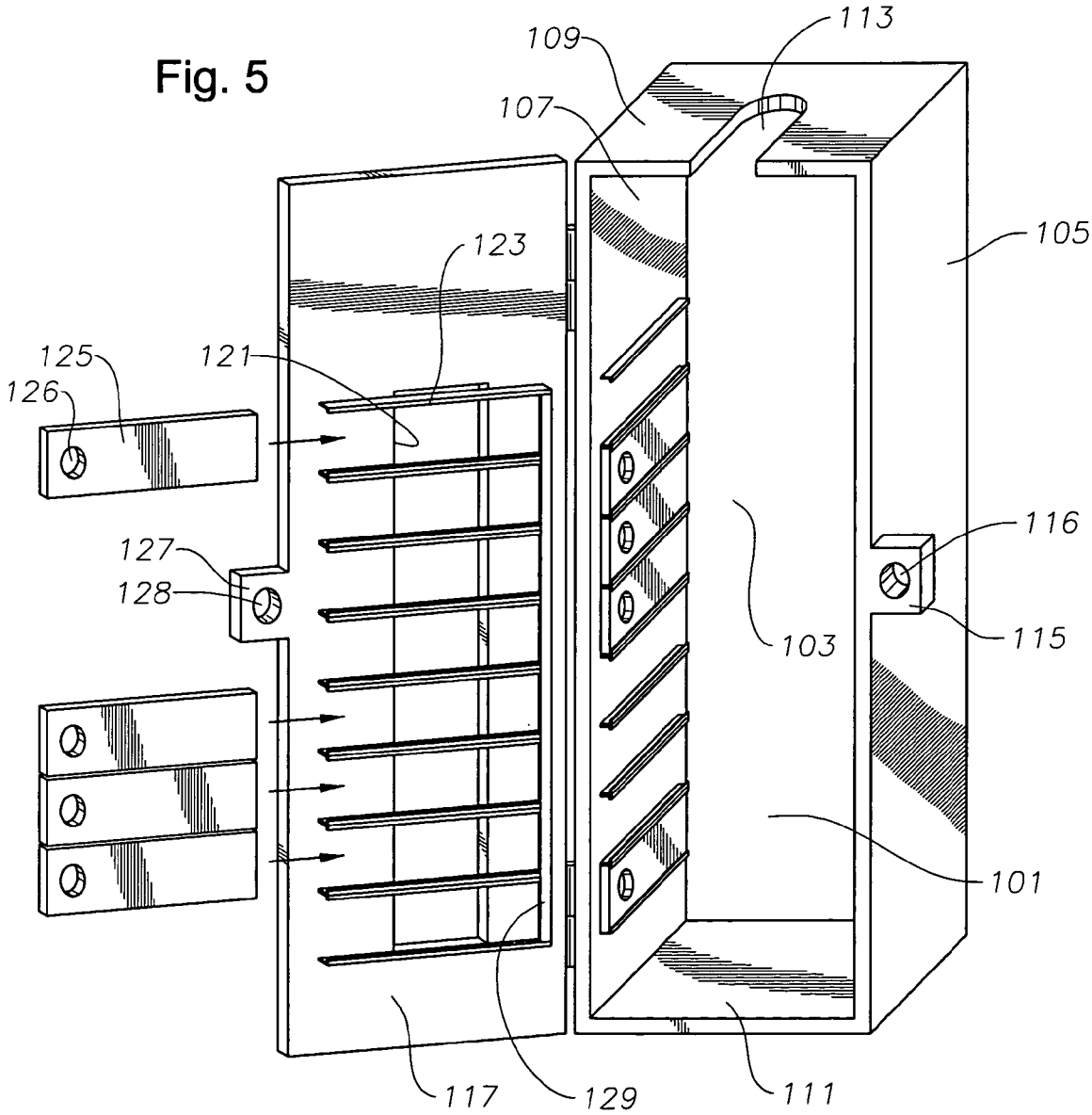
FIG. 5 is a perspective view of another alternate embodiment of a lockout box, where the blocking plates slide laterally into the blocking position.

FIG. 5 shows the next preferred embodiment of the invention. An enclosure 101 is comprised of a back piece 103, sidewalls 105 and 107, a top piece 109 with slot 113, and a bottom piece 111. Top 109 is affixed to sidewalls 105 and 107 and back piece 103. Bottom piece 111 is affixed to sidewalls 105 and 107 and back piece 103. Hasp 115 with hole 116 formed in it is affixed to sidewall 105 to allow a padlock to be passed through. A door 117 is affixed to sidewall 107 with hinges 119. As in the first embodiment, door 117 has a single aperture 121 that extends longitudinally along door 117 to provide access to all of the control buttons 13 of pendant 11 (FIG. 1) located within enclosure 101.

A plurality of runners 123 extend laterally across the interior side of door 117, perpendicular to the longitudinal axis of enclosure 101. Runners 123 are parallel to each other and in this embodiment, have the same width. The cross-sectional shapes of runners 123 are used to form channels into which blocking plates 125 can slide. Each runner 123 is adapted to receive one blocking plate 125, which slides laterally into a blocking position from the non-hinged edge of door 117. A hasp 127 with hole 128 is affixed on the exterior portion of door 117. Hole 128 allows a padlock to pass through it and hole 116, thereby locking door 117 to enclosure 101. A longitudinally extending stop 129 is located along an edge of each of runners 123 and extends the length of aperture 121. Stop 129 keeps blocking plates 125 in place once door 117 is closed and locked.

Runners 123 are spaced along the entire length of aperture 121. This gives the appearance that aperture 121 is divided into rectangles, one rectangle per control button 13 of pendant 11 (FIG. 1). Therefore, by sliding one of the blocking plates 125 into the appropriate runners 123, the rectangle corresponding to the blocked control button 13 is blocked by blocking plate 125. Blocking plates 125 may have a small hole 126 to facilitate sliding blocking plates 125 from the blocking position.

To lock enclosure 101 to door 117, hasps 115 and 127 come together with their respective holes 116 and 128 aligned. A padlock is then placed through holes 116 and 128, locking enclosure 101 and door 117 together. Once locked together, blocking plates 125 cannot be removed from the blocking positions.

Figure 6:
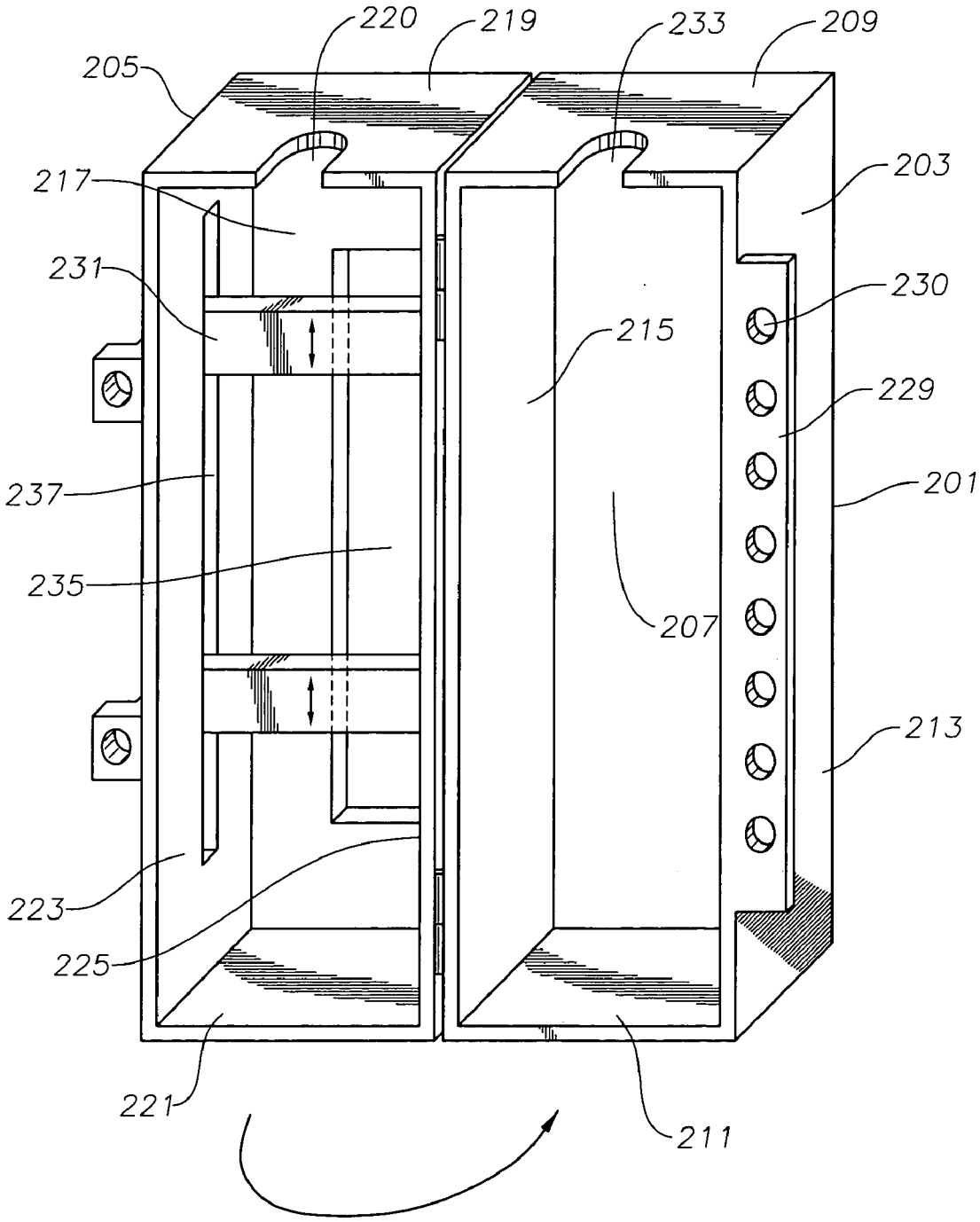
FIG. 6 is a perspective view of still another alternate embodiment of a lockout box, where the blocking plates are slideable and protrude through a slot on the sidewall away from the hinges.
Figure 7:
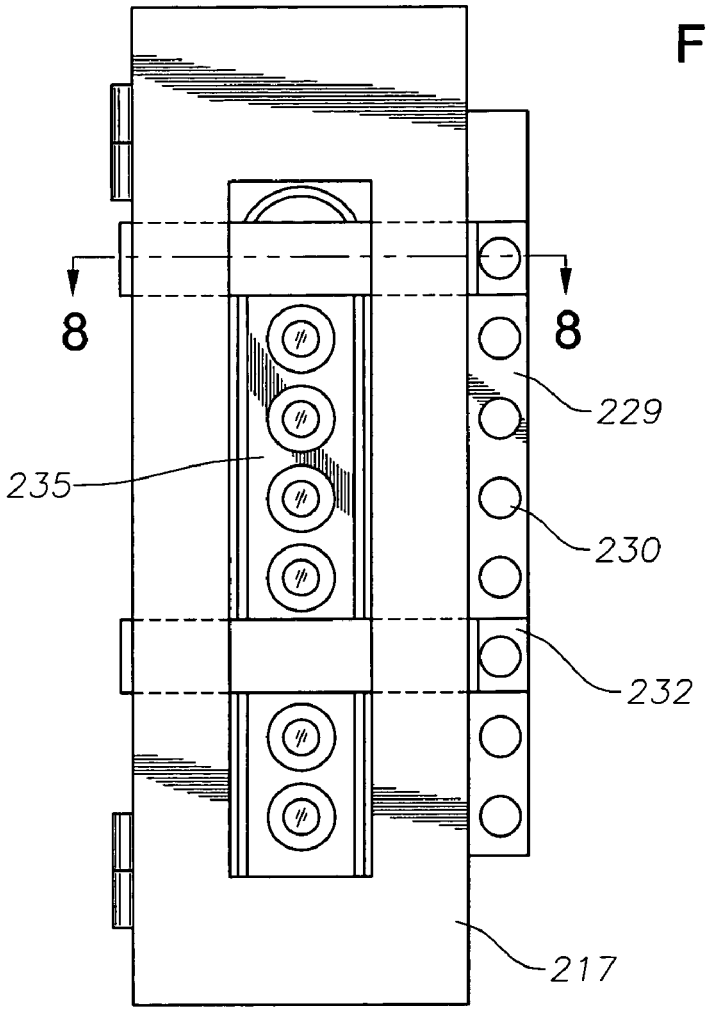
FIG. 7 is an elevational view of the front of the lockout box of FIG. 6.
Figure 8:
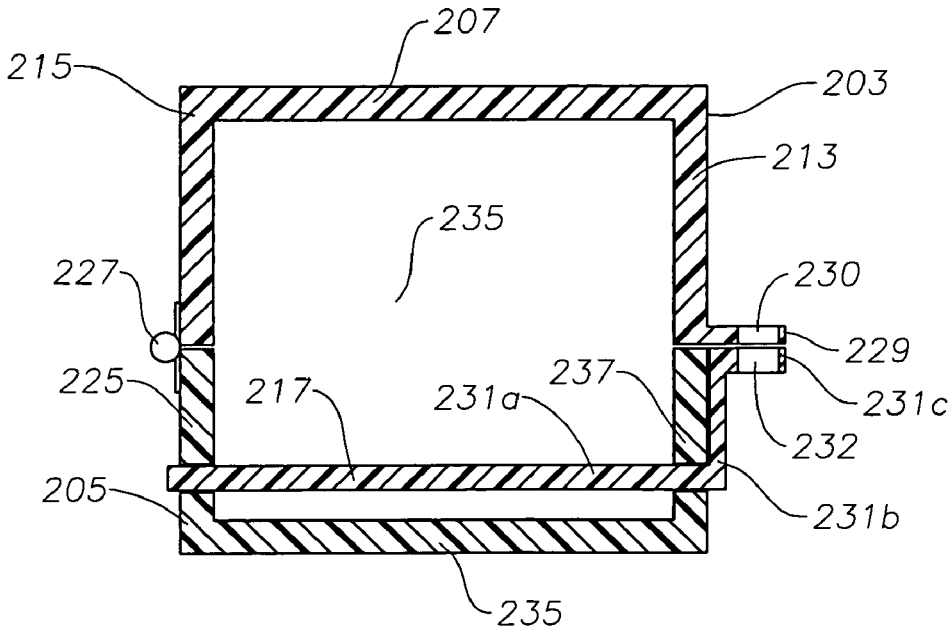
FIG. 8 is sectional view of the lockout box of FIG. 6, taken along the line 8—8 of FIG. 7.

FIGS. 6,7, and 8 are various views of the third embodiment of lockout box 201. In this embodiment, lockout box 201 has two halves or portions 203 and 205, one of which may be considered a door. Portion 203 is comprised of a back piece 207 affixed to a top piece 209, a bottom piece 211, and two sidewalls 213 and 215. Portion 205 is comprised of a front piece 217 affixed to a top piece 219 with a slot 220, a bottom piece 221, and two sidewalls 223 and 225. Portions 203 and 205 are hinged together by a hinge 227 (FIG. 8) affixed to sidewalls 215 and 225.

A locking bracket 229 with a plurality of holes 230 is affixed to the exterior of sidewall 213. Holes 230 are evenly spaced to allow a blocking plate 231 to cover a selected control button 13. A hole 232 in a foot 231*c* of blocking plate 231 selectively aligns with holes 230, thereby allowing a padlock to be placed through holes 230 and 232, locking portions 203 and 205 together. Top piece 209 has a slot 233 cut out of it to accept cable 15 (FIG. 1) when pendant 11 (FIG. 1) is placed into the enclosure 235.

Front piece 217 has an aperture 237, which allows access to control buttons 13 not blocked by blocking plate 231 when portions 203 and 205 are locked together and blocking plate 231 locked in place. A slot 239 is longitudinally formed in sidewall 223 to allow blocking plate 231 to slide to longitudinally to various positions behind aperture 237, thereby blocking the appropriate control button 13 (FIG. 1). A runner 241 (FIG. 8) is affixed on the interior side of sidewall 225 along the length of sidewall 225. An end of blocking plate 231 locates between runner 241 and the interior of front piece 217. Runner 241 retains blocking plate 231 close to aperture 237.

Blocking plate 231 is comprised of three portions. The first portion 231*a* is located in the interior of enclosure 235. Portion 231*a* slides along runner 241 and restricts access through aperture 237. A small part of the interior portion 231*a* protrudes through slot 239. The next portion of blocking plate 231 is a leg 231*b* that extends parallel with an exterior side of sidewall 223 until even with the end of sidewall 223. The foot 231*c* of blocking plate 231 turns and extends parallel with locking bracket 229. Holes 232 align with hole 230 and allow a padlock to pass through both holes 230 and 232, locking the two portions together and blocking plate 231 in a blocking position. Blocking plate 231 may be removed from portion 205 when the two portions 203 and 205 are not locked together by pulling it through slot 239. More than one blocking plate 231 may be used at once. Also one of the blocking plates 231 and runners 241 may be constructed wide enough to block more than one of the control buttons 13.

The invention has significant advantages. By placing the pendant into a lockout box, selecting the appropriate blocking plate, and shutting and locking the door, the control buttons of the crane that should not need to be used are blocked securely. This avoids having to completely cut off the power to the overhead crane. It also avoids wrapping the pendant with tape. By more securely blocking access to the unusable control buttons, the operator is less likely to accidentally manipulate the unusable control buttons, but allows the operator to still operate the overhead crane if the need arises.

Further, it will also be apparent to those skilled in the art that modifications, changes and substitutions may be made to the invention in the foregoing disclosure. For example, individual blocking plates, such as those of FIG. 5, could be hinged to the exterior of the door over the access aperture. Accordingly, it is appropriate that the appended claims be construed broadly and in the manner consisting with the spirit and scope of the invention herein.

We claim:

1. A lockout box to receive a pendant having control buttons, comprising:

an enclosure for receiving the pendent therein;

an aperture in the enclosure for providing access to the control buttons of the pendant located therein; and at least one moveable blocking plate carried by the enclosure and positionable in a blocking position over part of the aperture to block access to at least one of the control buttons, while other of the control buttons on the pendant are accessible through the aperture.

2. The lockout box according to claim 1, wherein the blocking plate is lockable in the blocking position.

3. The lockout box according to claim 1, wherein the enclosure has an access door for the pendant to be placed into and removed from the enclosure.

4. The lockout box according to claim 1, wherein the blocking plate is slideable into the blocking position.

5. The lockout box according to claim 1, wherein the enclosure has an opening for an electrical cable of the pendant to pass through.

6. The lockout box according to claim 1, wherein said at least one moveable blocking plate comprises a plurality of blocking plates.

7. The lockout box according to claim 1, wherein the enclosure has a door, and wherein the aperture is located in the door.

8. The lockout box according to claim 1, wherein the enclosure has a door that is hinged.

9. A lockout box to receive a pendant having control buttons, comprising:

an enclosure having an access door through which the pendant may be placed into and removed from the enclosure;

an aperture in the door of the enclosure for providing access to the control buttons of the pendant located therein;

an opening in the enclosure for a cable of the pendant to pass through; and at least one moveable blocking plate carried within the enclosure on an inner side of the door and positionable in a blocking position over part of the aperture to block access to one or more of the control buttons, while the remaining control buttons on the pendant are accessible through the aperture.

10. The lockout box according to claim 9, wherein the enclosure has a longitudinal axis and the blocking plate slides parallel to the longitudinal axis into the blocking position.

11. The lockout box according to claim 9, wherein the enclosure has a longitudinal axis and wherein said at least one blocking plates comprises a plurality of blocking plates that are slideable perpendicular to the longitudinal axis along the door of the enclosure into the blocking position.

12. The lockout box according to claim 9, wherein the blocking plate has a width much smaller than a length of the aperture, the blocking plate being slideable along the length of the aperture and lockable in selected positions.

13. The lockout box according to claim 9, wherein the blocking plate has a length and width at least equal to the aperture, and wherein the blocking plate has at least one hole for providing access to at least one of the control buttons.

14. The lockout box according to claim 9, wherein:

the blocking plate has a length and width at least equal to the aperture;

the blocking plate has a plurality of holes for providing access to a plurality of the control buttons; and the blocking plate can be inverted for providing access to different control buttons.

15. A method for blocking access to at least one control button of a pendant comprising:

(a) providing an enclosure with an aperture;

(b) inserting the pendant into the enclosure with control buttons of the pendant aligned with the aperture; and (c) affixing a blocking plate over part of the aperture into a blocking position to block access to at least one of the control buttons, while other control buttons on the pendant are accessible through the aperture.

16. The method according to claim 15, wherein step (c) comprises locking the blocking plate in the blocking position.

17. The method according to claim 15, wherein step (a) further comprises locking the pendant into the enclosure.

18. The method according to claim 15, wherein step (b) comprises opening a door of the enclosure and inserting the pendant into the enclosure, and step (c) comprises placing the blocking plate within an interior of the enclosure, then closing and locking the door.

19. The method according to claim 15, wherein step (b) comprises opening a door of the enclosure and inserting the pendant into the enclosure, and step (c) comprises sliding the blocking plate along an interior portion of the door.

* * * * *